US011084645B2

(12) United States Patent
Har-Shai

(10) Patent No.: US 11,084,645 B2
(45) Date of Patent: Aug. 10, 2021

(54) PROPELLANT-FREE CONTINUOUS DISPENSER

(71) Applicant: GreenSpense Ltd., Misgav (IL)

(72) Inventor: Gadi Har-Shai, Hod-HaSharon (IL)

(73) Assignee: GreenSpense Ltd., Misgav (IL)

( * ) Notice: Subject to any disclaimer, the term of this patent is extended or adjusted under 35 U.S.C. 154(b) by 0 days.

(21) Appl. No.: 16/478,485

(22) PCT Filed: Jan. 17, 2018

(86) PCT No.: PCT/IL2018/050063

§ 371 (c)(1),
(2) Date: Jul. 17, 2019

(87) PCT Pub. No.: WO2018/134816

PCT Pub. Date: Jul. 26, 2018

(65) Prior Publication Data

US 2019/0367252 A1 Dec. 5, 2019

Related U.S. Application Data

(60) Provisional application No. 62/447,082, filed on Jan. 17, 2017.

(51) Int. Cl.

| | |
|---|---|
| ***B65D 83/00*** | (2006.01) |
| ***B65D 83/20*** | (2006.01) |
| ***B65D 83/38*** | (2006.01) |

(52) U.S. Cl.

CPC ..... *B65D 83/0022* (2013.01); *B65D 83/20* (2013.01); *B65D 83/384* (2013.01)

(58) Field of Classification Search

CPC ... B65D 83/0022; B65D 83/20; B65D 83/384

(Continued)

(56) References Cited

U.S. PATENT DOCUMENTS 3,294,289 A * 12/1966 Bayne ..... B67D 1/0462 222/95

3,838,796 A 10/1974 Cohen (Continued)

FOREIGN PATENT DOCUMENTS

| | | |
|---|---|---|
| DE | 8913739 | 2/1990 |
| WO | WO 2009/073718 | 6/2009 |

(Continued)

OTHER PUBLICATIONS

International Preliminary Report on Patentability dated May 6, 2019 From the International Preliminary Examining Authority Re. Application No. PCT/IL2018/050063. (9 Pages).

(Continued)

*Primary Examiner* — Vishal Pancholi

(57) ABSTRACT

A Propellant-Free continuous dispenser for dispensing liquid or viscous materials under pressure. The container comprises a tension surface, and a bag containing the liquid to be dispensed, which is in contact with the tension surface. An actuatable valve to which the bag is open serves to controllably release the liquid from the bag, and a diaphragm forms a floor to the tension surface underneath the bag. The diaphragm is elasticated and presses the bag against the tension surface to flatten the bag, thus to expel the contents under pressure.

19 Claims, 9 Drawing Sheets

(58) Field of Classification Search
USPC ..... 222/105, 107, 183, 387
See application file for complete search history.

(56) References Cited

U.S. PATENT DOCUMENTS

| | | | |
|---|---|---|---|
| 4,121,737 | A | 10/1978 | Kain |
| 4,771,918 | A | 9/1988 | Haggart |
| 5,044,524 | A | 9/1991 | Pistek |
| 5,143,260 | A | 9/1992 | Loychuk |
| 6,413,239 | B1 | 7/2002 | Burns et al. |
| 2013/0284760 | A1 | 10/2013 | Orr |

FOREIGN PATENT DOCUMENTS

| | | |
|---|---|---|
| WO | WO 2014/111939 | 7/2014 |
| WO | WO 2018/134816 | 7/2018 |

OTHER PUBLICATIONS

International Search Report and the Written Opinion dated Apr. 10, 2018 From the International Searching Authority Re. Application No. PCT/IL2018/050063. (11 Pages).
Supplementary European Search Report and the European Search Opinion dated Sep. 17, 2020 From the European Patent Office Re. Application No. 18741998.1. (10 Pages).

* cited by examiner

PROPELLANT-FREE CONTINUOUS DISPENSER

RELATED APPLICATIONS

This application is a National Phase of PCT Patent Application No. PCT/IL2018/050063 having International filing date of Jan. 17, 2018, which claims the benefit of priority under 35 USC § 119(e) of U.S. Provisional Patent Application No. 62/447,082 filed on Jan. 17, 2017. The contents of the above applications are all incorporated by reference as if fully set forth herein in their entirety.

FIELD AND BACKGROUND OF THE INVENTION

The present invention, in some embodiments thereof, relates to a propellant-free spray canister, that is to a pressurized dispensing device for dispensing liquids, foam, gels, pastes, viscous materials and the like under pressure and, more particularly, but not exclusively, to devices that provide the pressure using elastic.

Aerosol, are continuous dispensing devices that deliver materials under pressure, are well-known and in use in many common products for daily or frequent use. Aerosols are made in two ways, Single Compartment devices, a deliverable material is mixed with a propellant such as pressurized gas and sprayed through a valve. In Dual Compartment devices, deliverable material may be stored separately to the propellant for example to increase product shelf life. In either case, the propellant is the energy source of the device, enabling delivery via a valve.

Aerosol containers are generally restricted to a standard, cylindrical shape and required to be made of metal, and in other cases rigid plastic or thick glass, restricted to size and volume in order to safely withstand pressure. Some containers are coated with lacquer or other coatings to prevent rusting inside and/or outside the container. Production, transportation and handling of such containers is limited (e.g., in quantities) because of the hazardousness of either the propellant (explosive and flammable) or propellant and product and in addition, such containers are not easily disposable in an eco-friendly manner.

International Patent Application No PCT/IL2012/050063 to the present inventor discloses the use of an elastic sleeve to impart pressure to a bag of dispensable material positioned within the sleeve. Pressure so created pressurizes contents of the bag, which can then be dispensed through a valve and no propellant is needed.

International Patent Application No. PCT/IL2014/050059 also to the present inventor, discloses a device for dispensing a material under pressure, including an elastic portion defining a wall of a chamber defining a volume within which the material is to be contained; and a non-elastic portion coupled to the elastic portion and affecting a geometry of one or both of the elastic portion and of the chamber. When the material is initially placed within the chamber, the elastic portion is stretched so as to urge a reduction in volume of the chamber by at least 70% during dispensing.

International Patent Application No. PCT/IL2017/050061 to the present inventor, discloses a propellant free continuous dispensing device comprises an inner bag surrounded by an elastic sleeve containing fluid under pressure, a valve attached to the inner bag to controllably release fluid, the valve mounted in a mounting cup, a package enclosing the inner bag and elastic sleeve which may be of non-metallic material, a flange closing the package at one end, the flange being sized for the mounting cup to fit within the flange, and wherein the flange and the mounting cup are provided with complementary shapes to allow for location of the mounting cap into the flange.

The sleeve arrangement as described in the above art above is not ideal for reuse, in that once the bag is evacuated it is no longer be correctly folded to expand without tearing.

It is further desirable to find constructions that include fewer parts for simpler assembly and to reduce the likelihood of failure, and if possible to find a construction method that does not require the careful folding of the inner bag.

SUMMARY OF THE INVENTION

The present embodiments may use an elastic diaphragm as the pressure element. The elastic diaphragm may be pre-stretched, generating high pressure on the content to be dispensed.

According to an aspect of some embodiments of the present invention there is provided a dispensing device for dispensing liquid or viscous materials under pressure, comprising:

a tension surface;

a bag for containing the liquid or viscous materials to be dispensed, the bag in contact with the tension surface;

an actuatable valve for releasing the liquid or viscous materials from the bag;

a passage from the bag to the actuatable valve, through the tension surface;

an elasticated diaphragm, the diaphragm forming a floor to the tension surface underneath the bag, the diaphragm such as to expand under the bag when liquid is forced under pressure into the bag and to press the bag against the tension surface to flatten the bag when the tension is released.

The device may comprise a circumferential ring part, the diaphragm having an outer circumference, the outer circumference of the diaphragm being clamped around the bag from the outside of the bag by the circumferential ring part.

The device may comprise an upper cover over the tension surface, wherein the circumferential ring part is connected to the upper cover by a plurality of connectors.

In an embodiment, the plurality of connectors are dispersed evenly around the circumference.

The device may comprise eight, more than eight, ten or more than ten of the connectors.

In an embodiment, the connectors comprise screws.

In an embodiment, the circumferential ring comprises a rim fitting under the bag circumference for at least one of secondary locking and sealing.

Embodiments may comprise a base member extending below the diaphragm and forming a void into which the diaphragm is extendible.

In an embodiment, the base member is flattened to provide a stable base for the dispensing device.

The bag may have an opening to the passageway, the device further comprising an adapter element having a shoulder, the shoulder element inserted below the opening to clamp edges of the opening to the passageway, thereby to prevent leakage of the fluid away from the passageway.

The device may comprise a finger operated actuator for actuating the valve to allow release of liquid through the passageway.

The diaphragm may comprise elastic material, and in embodiments may comprise a centrally located bulge.

In embodiments the diaphragm is constructed to exert different pressures depending on the product and the circumstances, examples include 3 bars, 4 bars, 5 bars, 6 bars 7 bars, 8 bars, 9 bars, 10 bars and more than 10 bars of pressure on the bag.

The tension surface may exert different pressures, depending on circumstances, examples being 3 bars, 4 bars, 5 bars and more than 5 bars of pressure on the bag.

The bag may be shaped to expand hemispherically. In an embodiment a flat base is welded to a hemispherical part.

A lock ring or nut may be provided above the tension surface. The lock ring presses on the tension surface when locked in position to prestress the tension surface. The lock ring or nut can also be released to allow removal of the tension surface to access the bag for replacement.

The ability to replace the bag makes for a refillable device.

Alternatively the device may be for one off use and be disposable.

A key may enable release of the lock ring, thereby to allow the removal of the tension surface to access the bag for replacement.

The key may have a central hollow to fit over the valve and actuator.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE SEVERAL VIEWS OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings.

DESCRIPTION OF SPECIFIC EMBODIMENTS OF THE INVENTION

Figure 1:
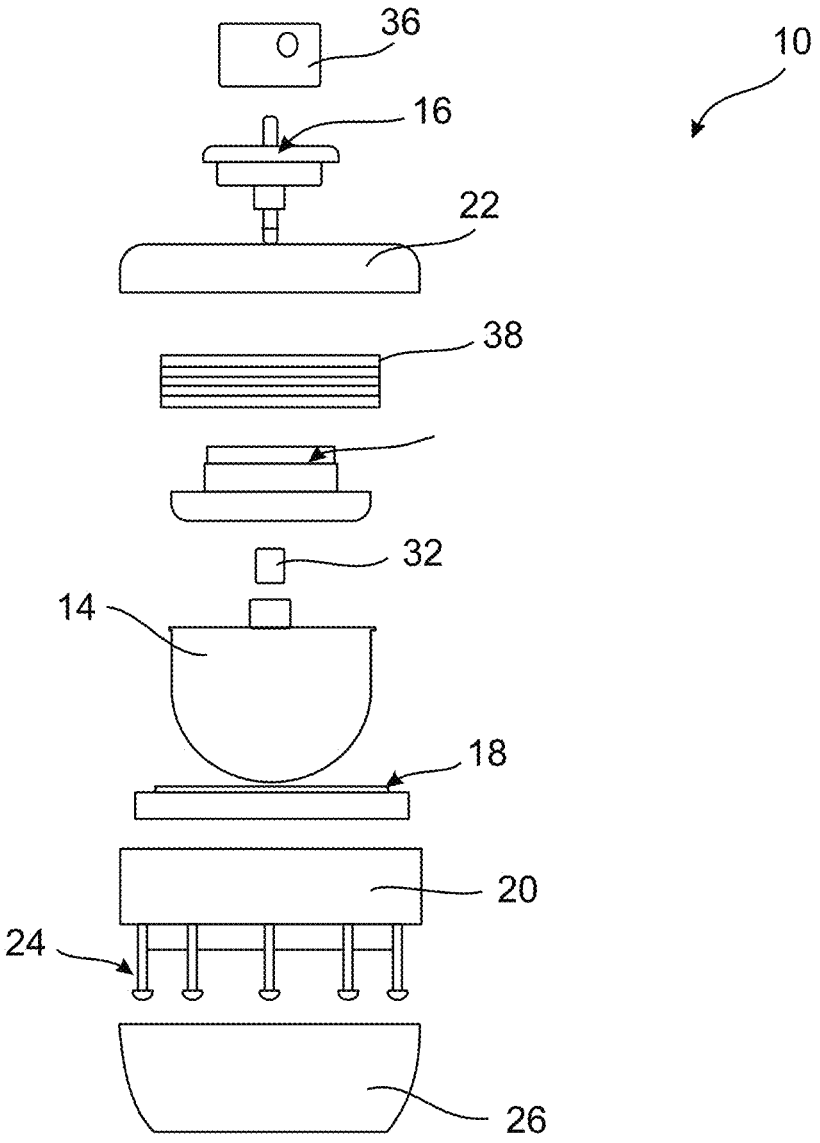
FIG. 1 is a simplified exploded diagram showing a dispenser with a diaphragm according to an embodiment of the present invention.

The present invention, in some embodiments thereof, relates as mentioned above to a pressurized dispensing device for dispensing liquids, foam, gels, pastes, viscous materials and the like under pressure and, more particularly, but not exclusively, to devices that provide the pressure without using a gas propellant.

A Propellant-Free Spray Cannister dispenses liquid under pressure. The canister comprises a tension surface, and a bag containing the liquid to be dispensed, which is in contact with the tension surface. An actuatable valve to which the bag is open serves to controllably release the dispensed material from the bag, and a diaphragm forms a floor to the tension surface underneath the bag. The diaphragm is elasticated and presses the bag against the tension surface to flatten the bag, thus to expel the contents under pressure.

The diaphragm is clamped around its circumference and around the bag to the top surface.

The packaged device of the invention enables airless, continuous dispensing of materials, for example in jar packages, to provide continuous spray dispensing of liquids, foams, gels, pastes, viscous materials and the like, such as skin care lotions, serums, perfumes and similar products, without the use of any propellants. The packaged device enables lavish, highly-differentiated free-form external packaging, using nearly any material (glass, ceramics, etc.), and in any shape and this is possible because there is no pressure enforced on the external package.

The packaged device of the invention enables high-barrier, refillable, airless and continuous dispensing. The device consists of a high-barrier pouch, filled with the product to be dispensed, and surrounded by an elastomer diaphragm. The diaphragm generates continuous, high-pressure dispensing that is silent, works at any angle and provides full product evacuation. Exemplary devices may support volumes of up to 45 ml and may be refilled. The device is eco-friendly and to this end, may be disposable and/or refillable.

Advantages of devices according to the present embodiments include, but are not limited to, continuous, airless dispensing without the use of any propellants. It is ideal inter alia for fine spray, foam, gel and semi-viscous products. The device supports high-end packaging designs in any shape, and from any material.

Devices according to the present embodiments may support natural products and green chemistry, reducing the need for antioxidants or preservatives. In an embodiment of the invention an aerosol device may be refillable for 'green', eco-friendly use. The device may be filled using regular aerosol filling lines or a BOV filling machine, but without the use of any propellant gas. Devices according to the present embodiments may reduce costs of production, handling, storage and transportation and thus may have many advantages over currently available products.

According to an embodiment of the present invention, there is provided a device and packaging for continuous dispensing of liquids, foams, gels, pastes, viscous materials and the like. The device of the invention does not use or require any gas propellants for pressurized dispensing of the material contained within the device. Instead, the device of the invention comprises an elastic diaphragm which is pre-stretched, to generate high pressure on the contents of the device and thus facilitate their dispensing. Devices according to the present embodiments may be held by hand, and operated by pressing with a single finger on the device actuator, as would be expected for a standard continuous dispensing device.

The device may be easily disposable after usage or re-usable by replacing the inner bag and contents with a new one for re-use.

The device of the present embodiments, not necessarily itself an aerosol device depending on the valve used, is a propellant-free continuous dispensing device and as will be discussed below, the internal shape is not made necessarily to conform to a standard Aerosol can. The external shape of the device may be square, rectangular, oval, hexagonal, polygonal, round, etc. examples of which can be seen in FIGS. 3A-C and 4A-C discussed in greater detail hereinbelow. The diaphragm itself may be shaped both with respect to its outline and also with respect to variations in thickness. The diaphragm may be made of one piece or from a number of layers, or as an elastic weave or as elastic strips. The package materials may be plastic, glass, metal, wood or any combination thereof.

The package and its components may be sterilized or radiated to suit the requirements of pharmaceutical, healthcare, cosmetic and similar products.

The following illustrates a device that is designed for single-handed operation using one finger to press. More generally, a device according to the present embodiments may be operated for example by pressing, or swivelling or shaking or dropping or using an external source, for example with an electrical valve. The outlet may be an actuator, a hose, a surface, another compartment etc.

A package according to the present embodiments may be used for dispensing of lotions, creams and perfumes among other products. Thus the present embodiments may be used as substitutes not just for existing aerosol containers but also for cream jars and the like and products using manual pumps.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

Referring now to the drawings, FIG. 1 is an exploded diagram which illustrates a dispensing device 10 for dispensing liquid under pressure according to embodiments of the present invention.

The dispensing device 10 comprises a tension surface 12, which presses down on a bag 14, which contains the liquid to be dispensed. The bag is in contact with the tension surface 12.

An actuatable valve 16 allows release of pressure and thus of the liquid from the bag. A passage extends from the bag 14 to the actuatable valve 16, through the tension surface 12, which passage is opened and closed by the valve 16.

Diaphragm 18 forms a floor to the tension surface 12 underneath the bag 14 and balloons out when liquid is forced under pressure into the bag. The diaphragm thus presses back against the bag to force the bag back against the tension surface to flatten the bag. In this way the contents of the bag are pressurized, and release of the valve may cause the liquid to be sprayed as an aerosol.

Below the diaphragm is a circumferential ring part 20. The diaphragm 18 has an outer circumference, which is clamped around the bag 14 from the outside by the circumferential ring part.

Figure 6:
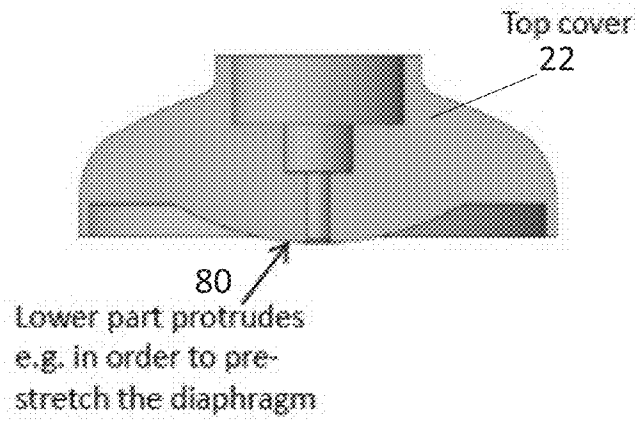
FIG. 6 is a simplified diagram showing cross sections of the circumferential ring, the diaphragm and the top cover of FIGS. 1 and 2A.
Figure 6:
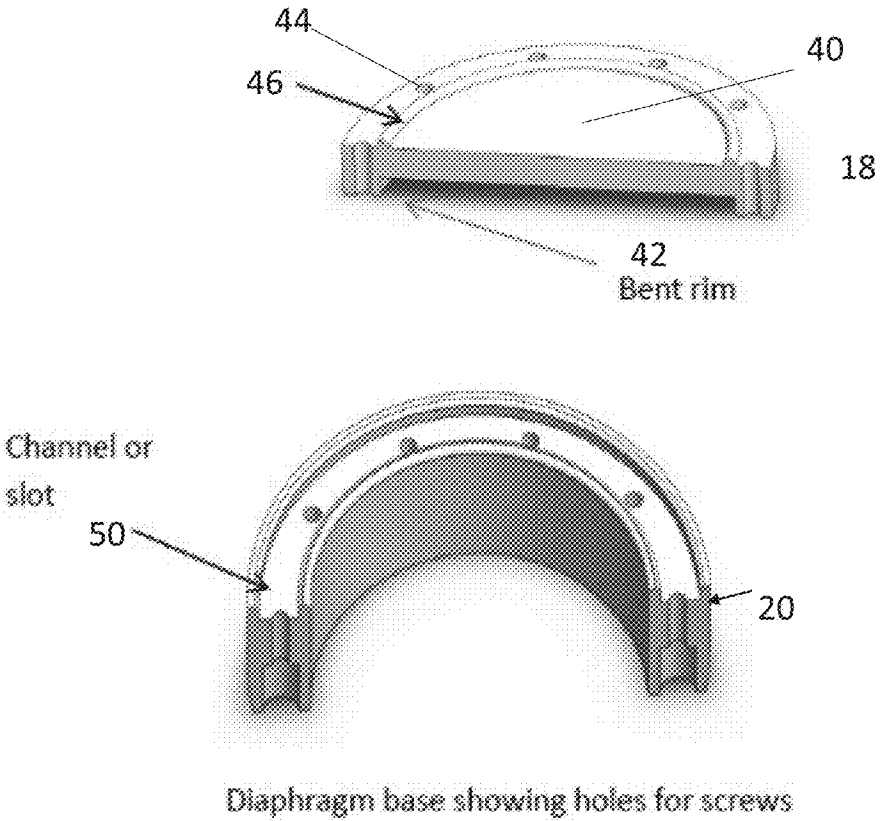

The circumferential ring part 20 clamps to upper cover 22 using connectors 24, typically screws or rivets and which may be metal. The screws may be distributed evenly around the circumference to ensure that the diaphragm is firmly held at all sides so as not to inadvertently release the bag from the pressure. In embodiments, eight or ten or more screws may be provided. The ring part 20 may include a rim, which fits under the bag circumference for secondary locking and/or sealing of the diaphragm within the clamp. The ridge is shown in FIG. 6.

Base member 26 extends below the diaphragm 18 forming a space or void into which the diaphragm can extend as pressurized liquid is forced into the bag.

The base member 26 may be flattened to provide a stable base for the dispensing device.

Figure 2A:
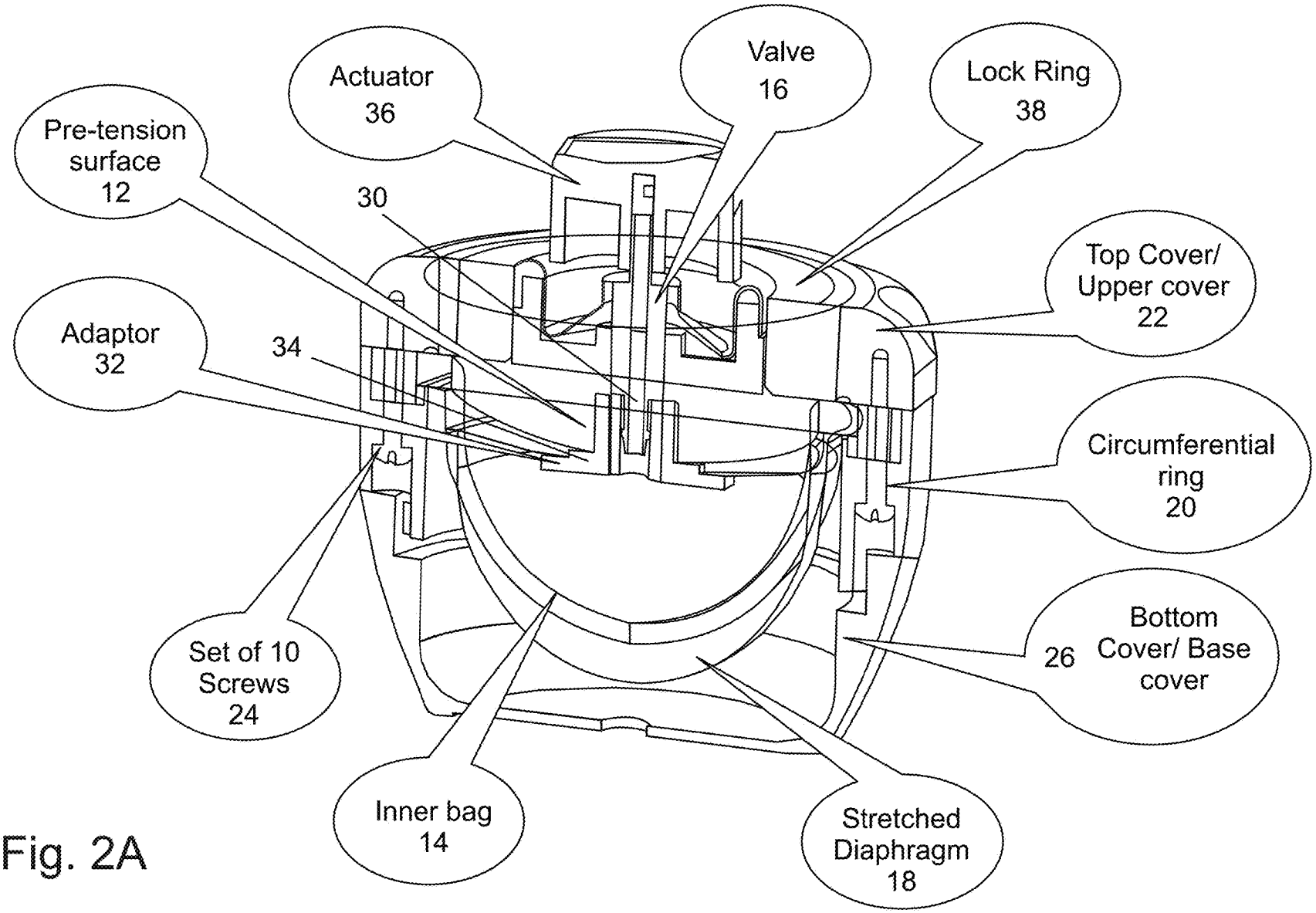
FIG. 2A is a simplified diagram showing a cross-section of the embodiment of FIG. 1 in assembled form.

Referring now to FIG. 2A, the bag 14 is open at the top, leading to passageway 30 which extends upwards to the valve. The device comprises an adapter element 32 having a shoulder 34. The shoulder 34 is inserted below the opening of the bag to clamp edges of the bag around the passageway. Thus it is possible to prevent leakage of fluid away from the passageway and into the voids of the device.

A finger operated actuator 36 allows the user to operate the valve 16, using a single finger, to allow release of liquid through the passageway. Thus the device is suitable for single-handed use.

A lock ring 38 may be fitted above the tension surface 12. The lock ring presses on the tension surface when locked in position to exert pre-tension on the bag 14. The lock ring may be released, as discussed in greater detail hereinbelow with respect to FIG. 8, so that the tension surface 12 can be removed. Thus the bag can be accessed for replacement.

The diaphragm comprises elastic material, and is designed to exert pressures suitable for spray, or dispensing of materials for example any of 3 bars, 4 bars, 5 bars, 6 bars 7 bars, 8 bars, 9 bars, 10 bars and more than 10 bars of pressure on the bag.

The tension surface is configured to exert pre-tension on the bag, for example any of 3 bars, 4 bars, 5 bars and more than 5 bars of pressure on the bag.

In greater detail, diaphragm 18 may be made of the compound generally as described in US publication 2015/0368438 of the same Assignee, but may also be made of other elastic or elastomeric materials individually or in combination, such as silicon, latex, natural rubber, synthetic rubber like EPDM, nitrile rubber, etc. Optionally additives such as stabilizers, cross linkers, activators, dispersants, plasticizers and fillers such as organoclays and nanoclays, carbon black, and so on may be included in the composition. The thickness of the diaphragm 18 is about 4 mm, (for example from 2 mm to 100 mm), e.g. to allow for generation of high pressure and enable stretching around the Inner bag 14 containing the material to be dispensed. The size of the Diaphragm 18 may be from 10 mm to 1000 mm in diameter and more, depending on the pressure required. Referring to FIG. 6, which shows a cross-section of the diaphragm 18, the center part 40 of the diaphragm 18 may be flat while the rim part 42 may be bent and may have holes 44 used for anchoring the diaphragm to circumferential ring 20. The thickness, shape and anchoring method may vary according to size and use. Ridge 46 may act as a secondary locking mechanism or sealing mechanism when clamped.

The diaphragm 18 is in general a flat, round, elastic or elastomeric part. This is unlike the sleeve described for example in U.S. Pat. No. 9,409,698, of the same Assignee, which is cylindrical. The diaphragm of the present embodiments is different in shape and function than the sleeve, which generates a surrounding pressure on the inner bag, while the diaphragm 18 applies pressure only from one side of the bag. However, the material from which the diaphragm 18 is made is typically the same nano-based elastomer as developed for the sleeve as described in US Publication No. 2015/0368438 of the same Assignee. The diaphragm 18 may be made of other elastic materials, such as silicon, latex, synthetic rubber, and so on, generally as described herein.

Continuing to refer to FIG. 6, the circumferential ring 20 may be used to clamp or anchor the diaphragm 18 in two ways. Ring 20 contains a channel 50 within the diaphragm's bent rim 42, to secure the diaphragm in place. Ring 20 further includes holes 52 to allow screws 24 to pass through the ring 20 and through the diaphragm 18 to screw on to the top cover 22 and thus tighten together the circumferential ring 20, the diaphragm 18 and the top cover 22 by compression force. The center 40 of the diaphragm 18 may thus stretch downwards for pressure generation on the filled inner bag 14 and its contents while the circumference and rim 42 are locked to the circumferential ring 20. The Circumferential ring 20 may be made of rigid material such as rigid plastic (HDPE, PP, Delarin, reinforced plastic, composite materials, etc.) as well as metal or tempered glass or a combination thereof, in order to withhold high forces and pressures generated by the stretched diaphragm 18. The diaphragm may be assembled to the circumferential ring 20 by stretching over the ring. Such stretching is one way of generating pre-tension of the diaphragm to ensure continued pressure on the bag to completely empty the bag.

Ten of the screws 24, say M2.5 screws, tighten the diaphragm in place. Of course, screws of other diameters may be used. The screws may alternatively be replaced with other kinds of connectors, say rods or rivets, that are clamped, snapped, heat welded, glued or mechanically locked to the circumferential ring 20 on one end and the top cover 22 at the other end. Other locking mechanisms are possible as well. The locking process may be carried out under external pressure that tightens the Circumferential ring 20, Diaphragm and Top cover together before locking occurs. These components can be locked in other ways such as gluing, heat welding, ultrasonic welding, or even by over-molding.

The base 26 is used as a protective hollow space for the stretched diaphragm and as a base for the package. The base 26 is not under pressure or other forces and therefore may be made of softer materials such as HDPE and Nylon as well as LDPE, PP, Delarin, or cardboard, but may also be made also from stronger material such as metal, tempered glass, etc. if desired. The base 26 may connect to the Circumferential ring 20 by snapping, screwing, gluing, heat welding, ultrasonic welding etc. Base 26 may optionally contain a viewing hole or gauge to view or show an indication of the remaining amount of the device content.

The actuator 36 may be any regular continuous dispensing actuator, e.g. 1" aerosol actuator or 20 mm aerosol actuator, as can be fitted to the device, male or female.

Any continuous dispensing valve, for example a 1" valve or 20 mm valve as well as other pressurized valves (such as fire distinguisher valves or similar) may be fitted to the device. The material to be dispensed is filled and released via the valve.

Top cover 22 may function as a cover of the chamber that is created by the Diaphragm and the Circumferential ring 20. The chamber contains the Inner bag 14 and the pre-tension surface 12 and may be exposed to pressure generated from the stretched Diaphragm. For this reason, the Top cover and Circumferential ring 20 may be made of a rigid material that can withstand pressure of up to 10 bars and more, such as rigid plastic (HDPE, PP, Delarin, reinforced plastic, composite materials, etc) as well as metal or tempered glass. The Top cover 22 connects to the Circumferential ring 20 with the aforementioned screws or rods 24. The Top cover 22 may include a small window to evaluate how much remains of the material being dispensed.

The pre-tension surface 12 is used to press on the inner bag 14 and as a result on the Diaphragm, in order to generate pre-tension or in other words "pre-pressure". Such pre-pressure continues to work on the inner bag to expel the last remaining materials from the bag at the end of dispensing. The pre-tension button is forced against the diaphragm by the Locker ring 38 that is screwed to the Top cover. The pre-tension surface 12 may be designed in different sizes in order to generate different pre-tension values, say between 1 to 3 bars and more. The surface may also allow the user to press on it directly to squeeze the last drops of material content when and if needed. The valve 16 is attached to the Top part of the pre-tension surface 12 and may be secured by crimping, clinching, gluing, heat welding, ultrasonic welding, snapping or screwing, and the pre tension surface 12 may be designed according to the method used. For example for crimping purposes the Pre-tension button may have a slot to accommodate the crimping. The pre-tension surface 12 may act as the valve spring housing generally as described in US application U.S. 62/289,248, and thus eliminate the necessity for further parts (i.e., spring housing, mounting cup) and avoid certain additional assembly processes, such as connecting the valve to the Top cover. The pre-tension surface 12 may comprise materials that can withstand pressure of up to 10 bars and more, such as rigid plastics (HDPE, PP, Delarin, reinforced plastic, etc.) as well as metal or tempered glass.

Figure 7:
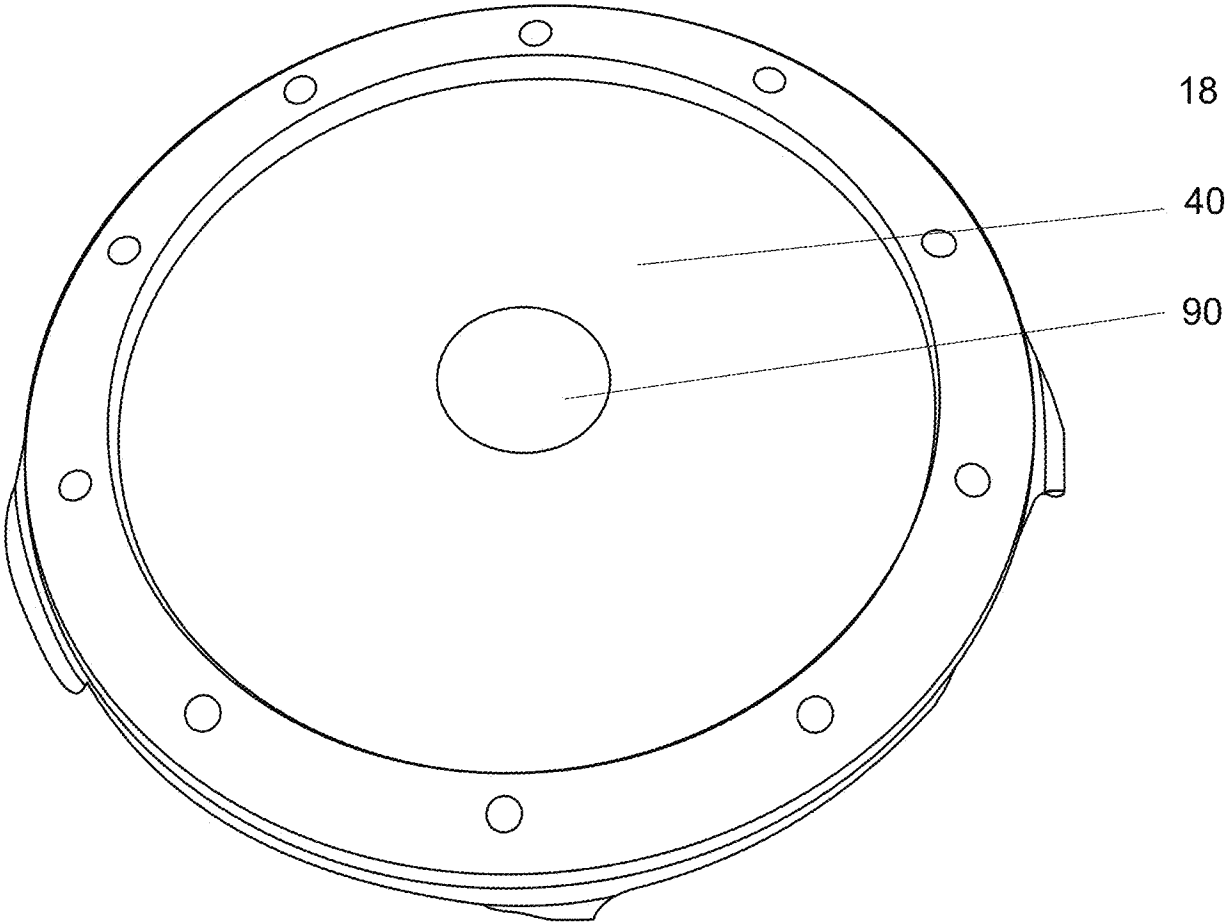
FIG. 7 is a simplified diagram showing an embodiment of the diaphragm of FIG. 6 in which there is variation in the thickness.

Locker Ring 38 is a nut that is screwed to the Top cover 22. The Locker nut 38 is screwed downward with key 60 as shown in FIG. 7, thus pushing the pre-tension button 12 down against the Inner bag 14 and consequently against the Diaphragm 18. When the locker ring is fully screwed down, the button is in full pre-tensioned mode. The Locker ring allows dismantling of the button in order to replace the inner bag with a new one for refilling purposes. In some cases where the package is not designed for re-filling, the locker ring may not be required and may be replaced with a Top cover that contains a pre-fixed Pre-tension button.

Figure 8:
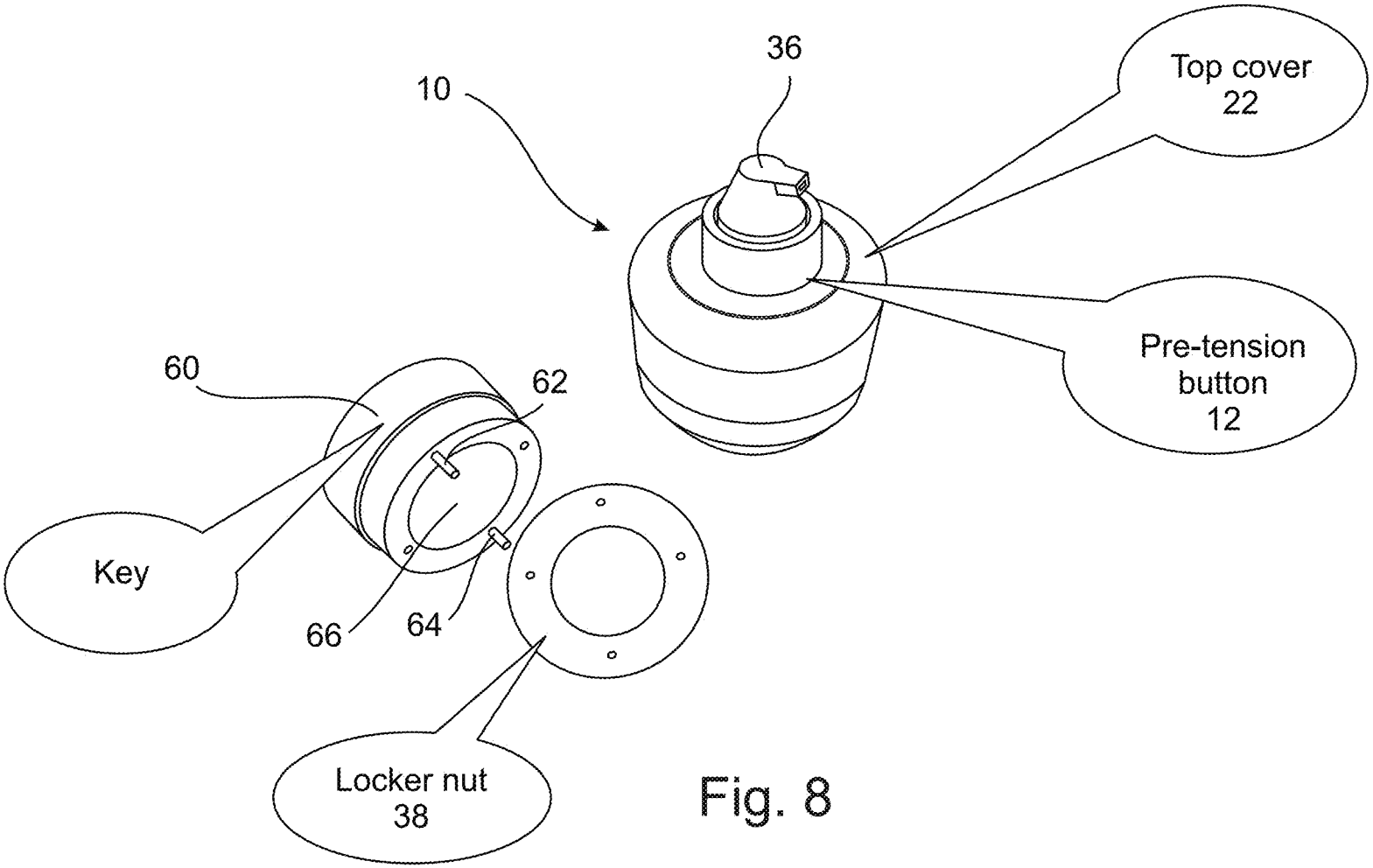
FIG. 8 is a simplified diagram illustrating the use of the locker nut and a key to replace an inner bag according to an embodiment of the present invention.

The locker ring or locker nut 38 is shown in FIG. 8, to which reference is now made. Key 60 may for example comprise two pins 62 and 64 that are inserted into corresponding holes in the locker nut 38 to allow for locking and release of the locker nut. A central hollow space 66 may fit over the valve and actuator of the dispenser device so that the pins may reach the holes in the locker nut 38. Other designs of key may be used, including powered keys or opening devices.

The inner bag 14 is the container for the material to be dispensed. The inner bag of the present embodiments may have the shape of a half sphere, with a top cover. This is contrary to inner bags described for example in U.S. Pat. No.

9,409,698 and PCT Application No. PCT/IL2016/051106, both of the same Assignee, and which is a cylindrical pouch inside an elastic sleeve, while the inner bag of the present embodiments may comprise a half sphere shape that may be pressurized only from one side of the half sphere. The inner bag may be made of a flexible, single or multi layered laminate, co-extrusion, blow molding having thickness equal or greater than 100 micrometers, and barrier characteristics (such as water vapor, or oxygen, odor) that are designed to maintain the material, and protect it in distribution and usage as well as increase or maintain shelf life. In addition, the bag 14 may have to withstand the pressure that is applied to it by the stretched diaphragm 18.

The various layers of the single or multilayer laminate may be made of various polymeric materials, polypropylene, polyethylene, polyamide, pet, polyurethane, etc., oriented or not, stretchable or not, metalized or not, with barriers layers such as EVOH, PVDF or not, with aluminum layer or not, or any common structures that are used today for high performance Flexible Packaging. The inner bag opens to passageway 30.

Figure 2B:
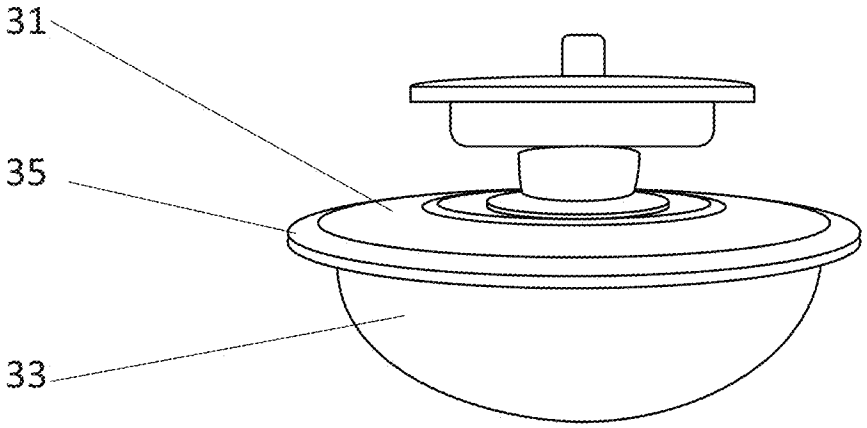
FIG. 2B is a simplified diagram showing how the inner bag of FIGS. 1 and 2A may be formed by welding together an upper flat and a lower generally hemispherical part.

Reference is now made to FIG. 2B which shows an embodiment of the inner bag made of two parts. The inner bag 14 may be constructed of a bottom part 31 shaped as a half sphere, in order to follow the diaphragm's shape when stretched. The bottom part may be heat welded to a round top 33, at welding line 35, and the whole may be laminated to create an inner bag.

Adaptor 32 surrounds the hole and connects the Inner bag 14 to the Pre-tension surface 12 or directly to the Top cover 22. The inner bag 14 may be placed empty and flat in the chamber that is created by the Diaphragm 18, Circumferential ring 20 and Top cover 22 and locked by the Adaptor 32 into place onto the Pre-tension surface 12. The inner bag may be flattened either by flattening the half sphere towards the flat top cover of the bag, or in a telescopic manner or other folding method. The Inner bag 14 may be designed to withstand high pressure and high friction to accommodate the filling and dispensing operation, using layer structures containing PE, PA, PU, Pet, and/or PP or any other structure that is common in the Flexible packaging industry with a total thickness of 30-300 microns. The volume of the bag may be anywhere between 10-60 ml and more. The volume of the bag may in some embodiment be anywhere between 10 ml to 30 l, and more.

The Adaptor 32 is used to connect the Inner bag 14 and the Pre-tension surface 12 or Top cover 22. The Adaptor 32 may be connected to both parts by means of heat or ultrasonic welding, snapping, gluing or and other mechanical means. The Adaptor may be made from a rigid or soft. i.e. not rigid, flexible, bendable, twistable or any combination of these properties material, as long as it can withhold pressure.

Figure 5B:
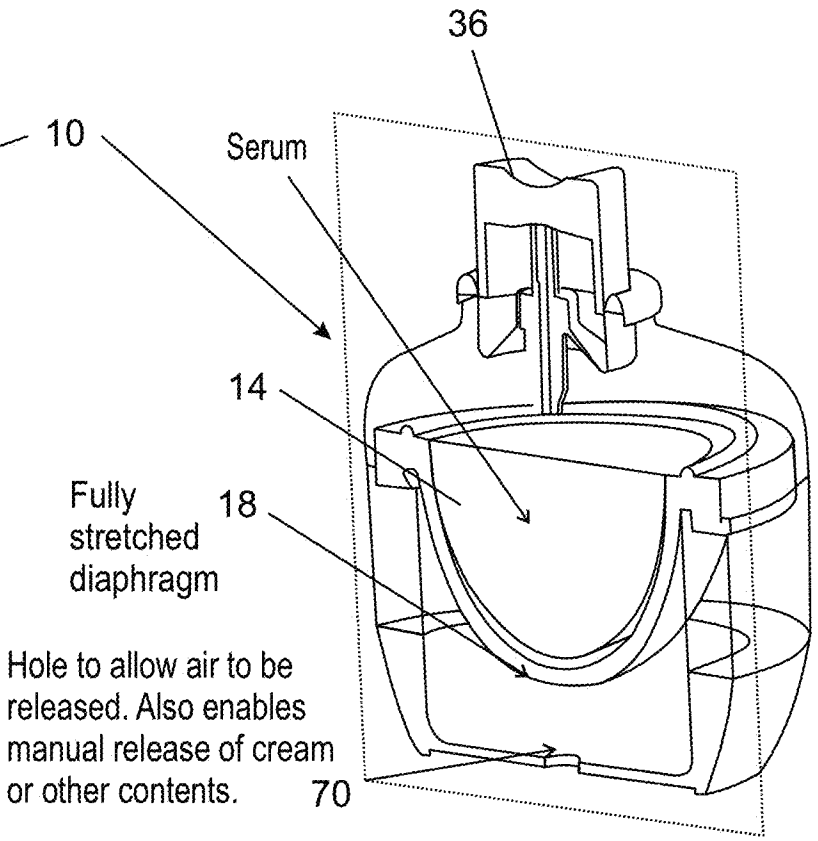
FIGS. 5A and 5B show longitudinal cross sections of the device of FIG. 2A with no pressure and with pressure respectively.
Figure 5A:
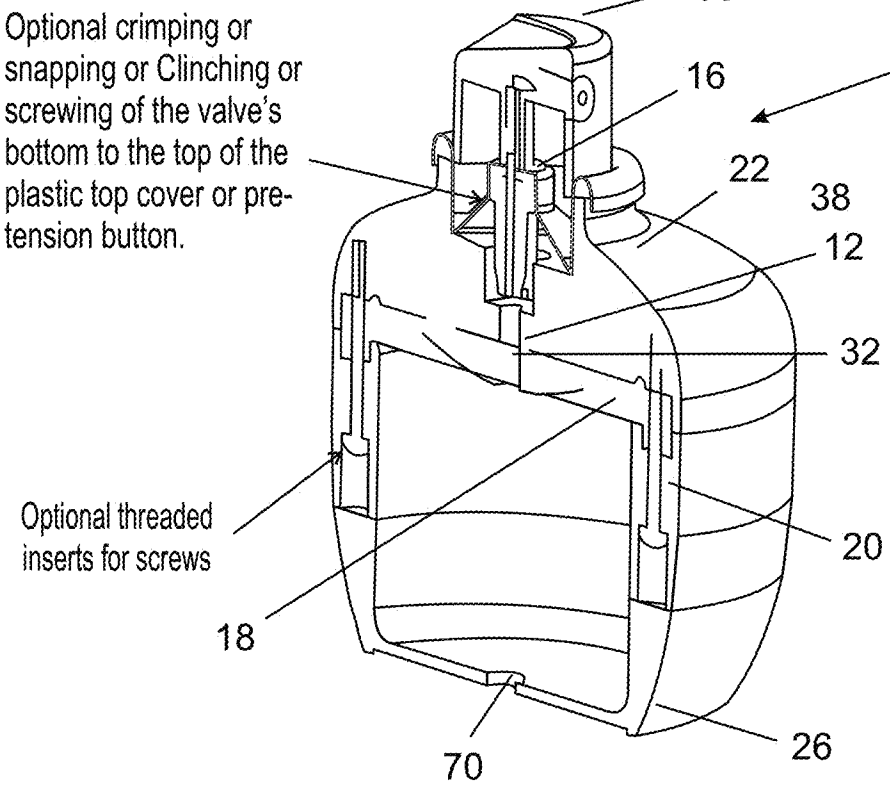

Reference is now made to FIGS. 5A and 5B which are longitudinal cross sections from different angles to provide further internal views of the device. Parts that are the same as in previous figures are given the same reference numerals and are not described again except as necessary for an understanding of the present embodiment. In FIG. 5A the device is unpressurized and diaphragm 18 lies flat against the pre-tension surface 12. In FIG. 5B, the inner bag 14 is filled and diaphragm 18 is extended into the void formed by base 26.

The diaphragm may for example stretch by 400%, 500% and even 1000% generating high pressure for dispensing, such as 3, 4, 5 bars and more.

Thus the inner bag 14 is flattened as in FIG. 5A, either by flattening the half sphere towards the flat top cover of the bag, or in a telescopic manner, when placed within the chamber. As shown in FIG. 5B, the inner bag 14 expands to a half sphere.

Figure 3C:
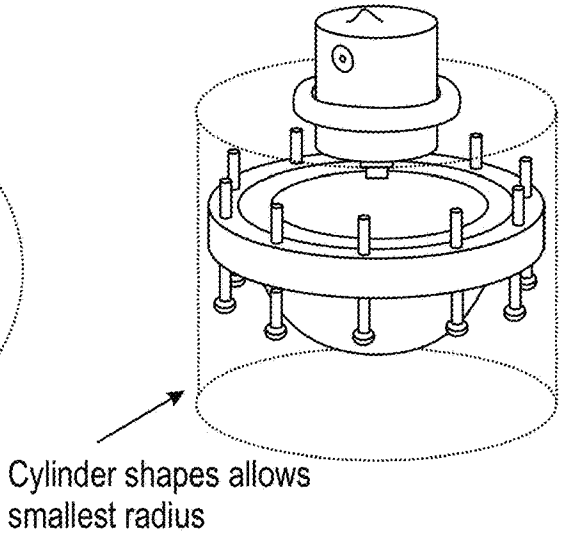
FIGS. 3A to 3C are simplified diagrams showing the structures of FIG. 2A in three different shapes of outer packaging.
Figure 3B:
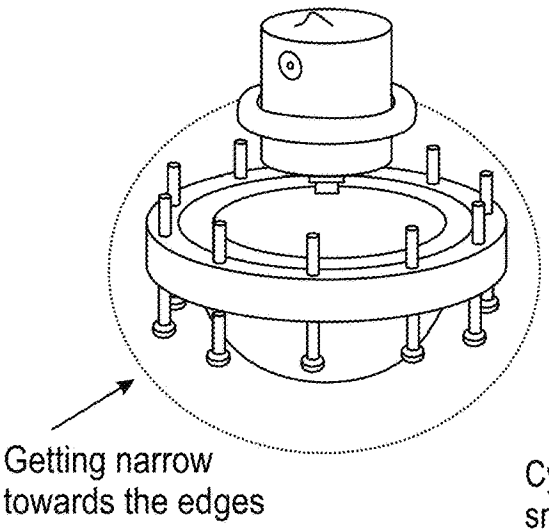
Figure 3A:
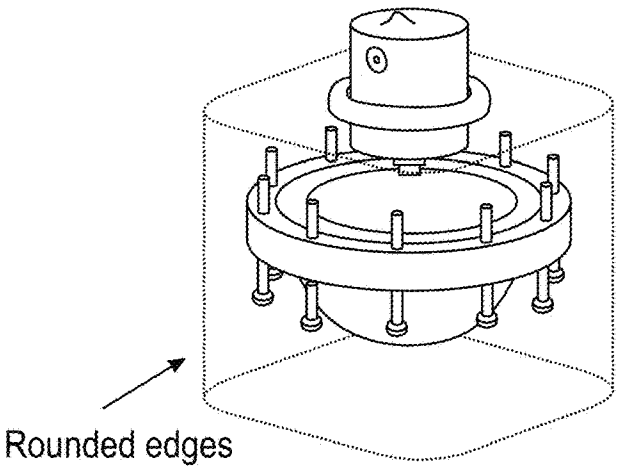
Figures 4A, 4B, 4C:
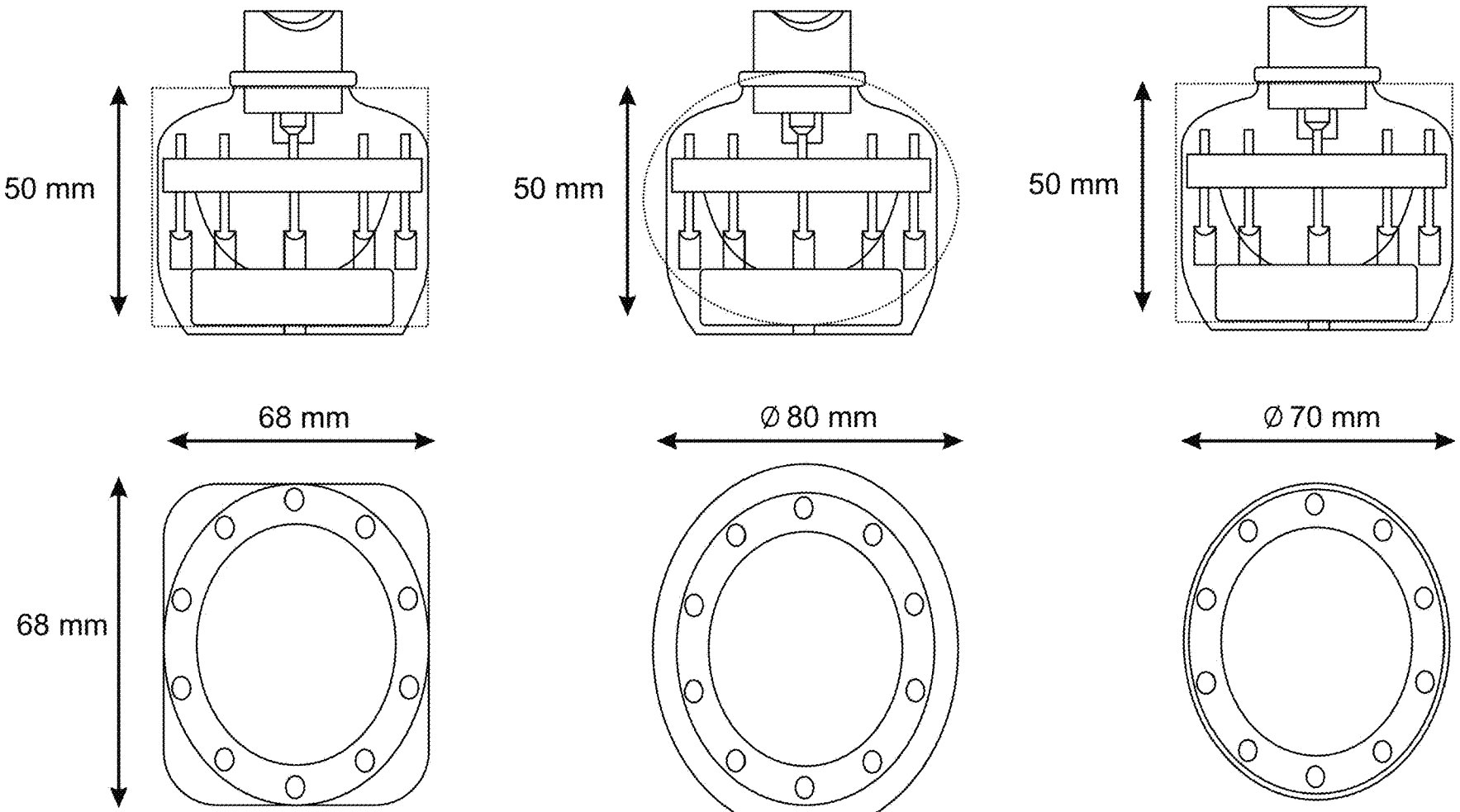
FIGS. 4A to 4C are three diagrams showing longitudinal and transverse cross sections of the packages of FIGS. 3A-C.

Reference is now made to FIGS. 3A to 3C and FIGS. 4A to 4C which show an internal structure according to FIG. 2A but with external shapes may be square with rounded edges FIG. 3A, rounded as in FIG. 3B and cylindrical as in FIG. 3C. FIGS. 4A to 4C show the same shapes side on with narrowing towards flattened bases, and in transverse cross section. Other possibilities include rectangular, oval, hexagonal, polygonal and round. The variety of shapes is possible since pressure considerations do not apply to the sides and base. The package material used for the side or base may be of any material, again since pressure considerations do not apply, and may include any of plastic, glass, metal, wood or any combination thereof. The package may be made using injection molding, blow molding or extrusion, or a combination of these.

The packaged device and its components may be sterilized or radiated to suit the requirements of pharmaceutical, healthcare, cosmetic and similar products.

Returning to FIG. 6, and the diaphragm 18 is shaped as discussed above in order to be firmly gripped at its edges 42 but still expand at the middle 40, and the diaphragm may be shaped both with respect to its outline and also with respect to variations in thickness. The diaphragm may be made of one piece or from a number of layers, and may comprise an elastic weave, or elastic strips.

The top cover 22 may include a protrusion 80 towards the lower center over which the diaphragm 18 may be stretched, as a way of providing pre-tension. The protrusion may be generated as part of the shape of the top cover 22. However, as per the embodiments above, the protrusion may be generated by separate pressure surface 12 which is pressed down by locking part 38.

The inner bag 14 may be made of single or multi layers, using lamination or co-extrusion methods. Alternatively the inner bag 14 may be constructed using blow molding, heat welding, vacuum forming, or a combination of these.

Reference is now made to FIG. 7, which is a simplified diagram showing an embodiment of the diaphragm 18 in which the central part 40 has a bulge 90. As the diaphragm expands, material from the tip spreads in all directions rather than along a single line of expansion. A bulge ensures that the tip has more material prior to expansion so that when expanded it does not form a weak point.

It is expected that during the life of a patent maturing from this application many relevant elastic and aerosol technologies will be developed and the scope of the terms elastic and aerosol are intended to include all such new technologies a priori.

The terms "comprises", "comprising", "includes", "including", "having" and their conjugates mean "including but not limited to".

As used herein, the singular form "a", "an" and "the" include plural references unless the context clearly dictates otherwise.

It is to be understood that the invention is not necessarily limited to the details of construction and the arrangement of the components and/or methods set forth in the description and/or illustrated in the drawings. The invention is capable of other embodiments or of being practiced or carried out in different ways.

It is expected that during the life of a patent maturing from this application many relevant dispensing mechanisms will be developed and the scope of the term 'dispensing mechanism' is intended to include all such new technologies a priori.

It is appreciated that certain features of the invention, which are, for clarity, described in the context of separate embodiments, may also be provided in combination in a single embodiment, and the above description is to be construed as if this combination were explicitly written. Conversely, various features of the invention, which are, for brevity, described in the context of a single embodiment, may also be provided separately or in any suitable subcombination or as suitable in any other described embodiment of the invention, and the above description is to be construed as if these separate embodiments were explicitly written. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety into the specification by reference, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A dispensing device for dispensing liquid or viscous materials under pressure, comprising:

a tension surface;

a bag for containing the liquid or viscous materials to be dispensed, the bag in contact with the tension surface;

an actuatable valve for releasing the liquid or viscous materials from the bag;

a passage from the bag to the actuatable valve, through the tension surface;

an elasticated diaphragm, the diaphragm forming a floor to the tension surface underneath the bag, the diaphragm such as to expand under the bag when liquid is forced under pressure into the bag and to press the bag against the tension surface to flatten the bag when the tension is released;

a circumferential ring part, the diaphragm having an outer circumference, the outer circumference of the diaphragm being clamped around the bag from the outside of the bag by the circumferential ring part; and an upper cover over the tension surface, wherein the circumferential ring part is connected to the upper cover by a plurality of connectors, wherein the plurality of connectors are dispersed evenly around the circumference, the plurality of connectors passing through holes in the diaphragm, the connectors not passing through the bag.

2. The dispensing device of claim 1, comprising eight, more than eight, ten or more than ten of the connectors.

3. The dispensing device of claim 1, wherein the connectors comprise screws.

4. The dispensing device of claim 2, wherein the circumferential ring comprises a rim fitting under the bag circumference for at least one of secondary locking and sealing.

5. The dispensing device of claim 1, comprising a base member extending below the diaphragm and forming a void into which the diaphragm is extendible.

6. The dispensing device of claim 5, wherein the base member is flattened to provide a stable base for the dispensing device.

7. The dispensing device of claim 1, the bag having an opening to the passageway, the device further comprising an adapter element having a shoulder, the shoulder element inserted below the opening to clamp edges of the opening to the passageway, thereby to prevent leakage of the fluid away from the passageway.

8. The dispensing device of claim 1, comprising a finger operated actuator for actuating the valve to allow release of liquid through the passageway.

9. The dispensing device of claim 1, wherein the diaphragm comprises elastic material.

10. The dispensing device of claim 1, wherein the diaphragm comprises a centrally located bulge.

11. The dispensing device of claim 9, wherein the diaphragm is constructed to exert one member of the group consisting of 3 bars, 4 bars, 5 bars, 6 bars, 7 bars, 8 bars, 9 bars, 10 bars and more than 10 bars of pressure on the bag.

12. The dispensing device of claim 1, wherein the tension surface is configured to exert one member of the group consisting of 3 bars, 4 bars, 5 bars and more than 5 bars of pressure on the bag.

13. The dispensing device of claim 1, wherein the bag is shaped to expand hemispherically.

14. The dispensing device of claim 1, comprising a lock ring above the tension surface, the lock ring pressing on the tension surface when locked in position and being releasable to allow removal of the tension surface to access the bag for replacement.

15. The dispensing device of claim 14, being refillable.

16. The dispensing device of claim 1, being disposable.

17. A key configured to fit the lock ring of claim 14, to enable release of the lock ring, thereby to allow the removal of the tension surface to access the bag for replacement.

18. The key of claim 17, configured with a central hollow to fit over the valve and actuator.

19. A dispensing device for dispensing liquid or viscous materials under pressure, comprising:

a tension surface;

a bag for containing the liquid or viscous materials to be dispensed, the bag in contact with the tension surface;

an actuatable valve for releasing the liquid or viscous materials from the bag;

a passage from the bag to the actuatable valve, through the tension surface;

an elasticated diaphragm, the diaphragm forming a floor to the tension surface underneath the bag, the diaphragm such as to expand under the bag when liquid is forced under pressure into the bag and to press the bag against the tension surface to flatten the bag when the tension is released, wherein the diaphragm has a first wall thickness and comprises a centrally located bulge, the centrally located bulge having a second wall thickness greater than said first wall thickness.

* * * * *